US006045958A

United States Patent [19]

Arai et al.

[11] Patent Number: 6,045,958

[45] Date of Patent: Apr. 4, 2000

[54] PHOTOCONDUCTOR FOR ELECTROPHOTOGRAPHY

[75] Inventors: Akio Arai; Hideki Kina, both of Nagano, Japan

[73] Assignee: Fuji Electric Co., Ltd., Japan

[21] Appl. No.: 09/241,134

[22] Filed: Feb. 1, 1999

[30] Foreign Application Priority Data

Feb. 2, 1998 [JP] Japan ..... 10-020597

[51] Int. Cl.[7] ..... G03G 5/047; G03G 5/082

[52] U.S. Cl. ..... 430/58.1; 430/86; 430/95; 430/130

[58] Field of Search ..... 430/58.1, 86, 95, 430/130

[56] References Cited

U.S. PATENT DOCUMENTS

| | | | |
|---|---|---|---|
| 3,467,548 | 9/1969 | Straughan | 430/58.1 |
| 3,973,960 | 8/1976 | Dulken et al. | 430/95 |
| 4,710,442 | 12/1987 | Koelling et al. | 430/95 |
| 4,770,965 | 9/1988 | Fender et al. | 430/86 |
| 5,021,310 | 6/1991 | Kitagawa | 430/58.1 |

*Primary Examiner*—Roland Martin
*Attorney, Agent, or Firm*—Morrison Law Firm

[57] ABSTRACT

A first selenium-arsenic layer of a photoconductor, deposited on a conductive substrate, has a thickness and arsenic concentration effective to preserve an electrically charged surface potential in darkness and to transport carriers generated on exposure to light. The first layer is between 20 to 70 μm thick. A second amorphous selenium-arsenic alloy layer, formed on the first layer, generates carriers on exposure to light. The surface roughness, Rmax., of the conductive substrate is less than or equal to 0.5 μm. The first layer, or both of the photoconductive layers, are doped with iodine. When both layers contain iodine, the iodine content of the second layer is equal to or less than that of the first layer. The thickness of the second layer is between 5 to 30 μm. The arsenic content of the amorphous selenium-arsenic alloy of the second layer is equal to or greater than that in the first layer. After deposition of the first and second layers, the photoconductor is heat treated at between 100° to 200° for 30 to 80 minutes. In a further embodiment the first layer of the photoconductor has an arsenic content in the range of 10 to 45 wt %. The second layer arsenic content is in the range of 25 to 45 wt %.

19 Claims, 5 Drawing Sheets

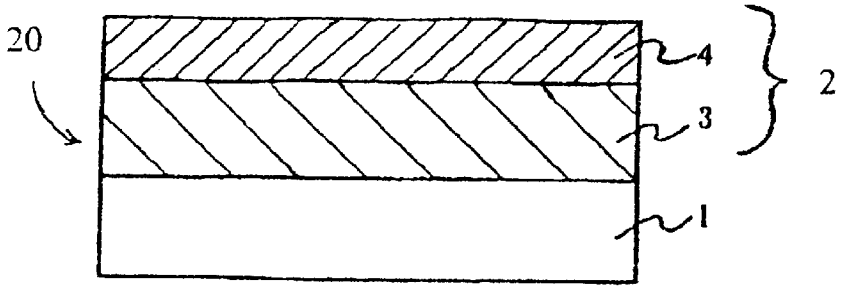
Fig. 1
Fig. 2
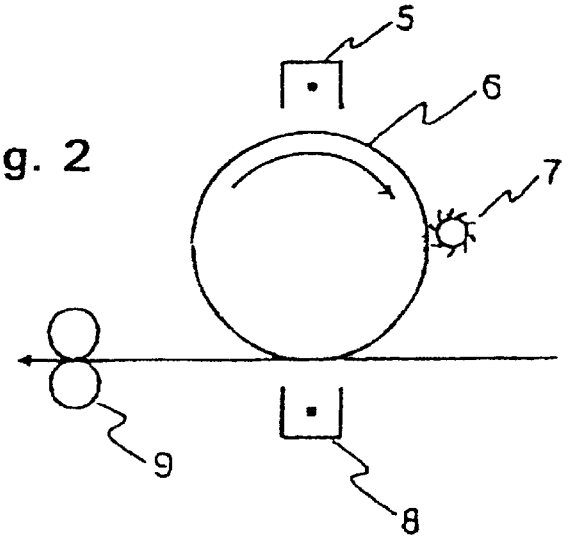
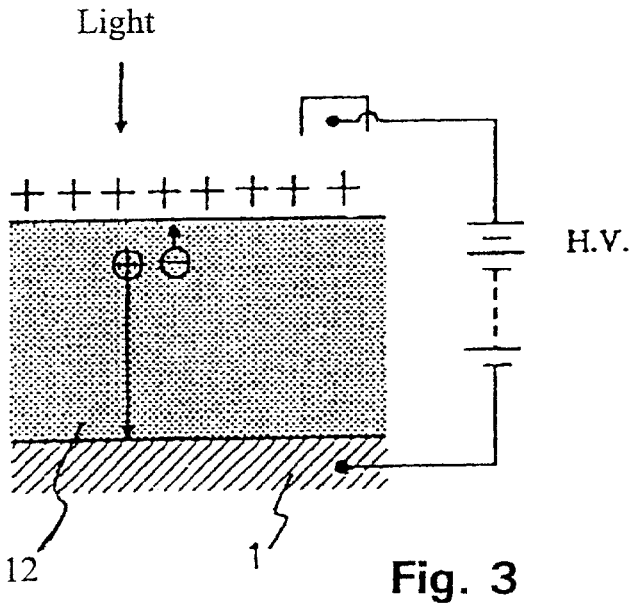
Fig. 3
PRIOR ART

PHOTOCONDUCTOR FOR ELECTROPHOTOGRAPHY

BACKGROUND OF THE INVENTION

The present invention relates to a photoconductor for electrophotography, which is central to electrophotographic devices, including copiers, printers, and facsimiles etc. In particular, the present invention relates to photoconductors utilized in high speed (100 A4 size sheets per minute or faster), high resolution (dot densities of 300 dpi or more) electrophotographic applications.

In recent years, the focus of research and development in electrophotographic devices such as copiers, printers, and facsimiles, etc. has been on developing higher print speeds and higher resolutions. Conventional electrophotographic devices have a print speed ranging from 40 to 100 sheets per minute on A4 size paper. Additionally, electrophotographic devices that employ photoconductors made of amorphous selenium, particularly amorphous selenium-arsenic alloys, have dot densities of 240 dpi or less. Photoconductors made of amorphous selenium exhibit excellent resistance to printing fatigue.

Photoconductors made of amorphous selenium-arsenic alloys are manufactured by vacuum depositing the amorphous selenium-arsenic alloy onto a substrate with a surface roughnesses, Rmax., ranging from 0.8 to 1.2 $\mu$m. Utilizing a cutting process, a photosensitive coating is produced that is between 60 to 80 $\mu$m thick. The photosensitive coating is subjected to an aging treatment enabling the photosensitive coating to stand up to repeated exposures to both light and dark conditions for extended periods of time.

The image forming process for electrophotographic devices (hereinafter devices) employing a cylindrical photoconductor is shown in FIG. 2. While being rotated (shown by the circular arrow), the surface of the photoconductor is charged with electricity through a charging means 5. Next the photoconductor is exposed to light consistent with the image information through an exposing means 6. This produces an electrostatic latent image. The latent image is processed by a developing agent through a developing means 7 to form a patent image. The patent image on the surface of the photoconductor is transferred to a carrier sheet such as paper through a copying means 8. The image is fixed to a carrier sheet through a fixing means 9.

The photosensitive coating of a conventional photoconductor is subjected to comparatively high charging potentials of between 800 to 1200 volts. Because the conventional photosensitive coating is relatively thick (60 to 80 $\mu$m), image defects such as point defects are prevented from manifesting themselves even when the substrate is relatively rough (Rmax.) of 0.8 to 1.2 $\mu$m.

The problem with electrostatic latent image formation is that the higher the print speed, namely the larger the rotational velocity of the photoconductor, the less light is available to expose the surface of the photoconductor. Reduced light thus requires a more sensitive photoconductor. Also, the shorter interval of time between the exposing and developing processes in a photoconductor causes the developing process to begin before the surface potential has time to decay completely. Surface potential decay requires a period of time after the surface of the photoconductor is exposed to light. The short time available for decay leads to deteriorating image quality along with patent image disorders such as image contrast problems etc.

Referring now to FIG. 3, describes the charging, exposing, and potential decaying processes of a conventional photoconductor. Electrically charged surface potential decays as follows:

1) Mono-layered photosensitive coating 12 (which is, for example, positively charged thereby inducing a negative charge in substrate 1) is exposed to light;
2) this exposure produces negative and positive carriers in mono-layered photosensitive coating 12;
3) each carrier migrates towards the surface of substrate 1 or the surface of mono-layered photosensitive coating 12 depending on its charge;
4) these carriers neutralize the electric charges on each surface to complete the decay of the electrically charged surface potential.

The migration time of the carriers determines the potential decay period or photoresponse. Low mobility of carriers and long potential decay periods cause conventional photoconductors to have poor photoresponses. This results in deterioration of image quality when applied to high speed devices.

It is possible to secure more time for potential decay by making the outer diameter of the cylindrical photoconductor larger, but there are limits to the size you can make the photoconductor. The size of the photoconductor is constrained by the size of the overall device. In order to improve resolution, photoconductors employ developing agents with very fine particles. This results in a higher dot density. However, because conventional photosensitive coatings are so thick, incident light causes the generated carriers to move transversely. This causes the images to blur and fade. An overall reduction in the sharpness of the images results.

On the other hand, reducing the thickness of the photosensitive coating poses practical problems. Thin photosensitive coatings cause white or black point defects to appear on the images. These defects are caused by burrs left on the substrate during the cutting process. The cutting process leaves the surface of the substrate with a roughness in the range of 0.8 to 1.2 $\mu$m as measured on the basis of surface roughness termed Rmax. Additionally, conventional photoconductors lack the sensitivity required for high speed devices.

OBJECTS AND SUMMARY OF THE INVENTION

It is an object of the present invention to provide a photoconductor which overcomes the problems described above.

It is a further object of the invention to provide a photoconductor having improved resolution and sensitivity.

It is a still further object of the invention to provide a photoconductor which permits increased throughput for high-speed operation.

It is a still further object of the invention to provide a photoconductor capable of operating at a lower charge potential, which reduces the time required for discharge.

The present invention provides a multilayered photosensitive coating formed on a conductive substrate. The photosensitive coating is composed of two layers. The first layer functions mainly in preserving the electrically charged surface potential in darkness and in transporting carriers generated when exposed to light. The second layer is formed on the first layer, and also serves in generating carriers when exposed to light. Both layers are comprised of amorphous selenium-arsenic alloys. The arsenic content of the second layer is equal to or greater than that of the first layer.

While increasing the arsenic content in the amorphous selenium-arsenic alloy increases the sensitivity, it decreases the preservability of electrically charged surface potential. The present invention uses a two-layered photoconductor where the arsenic content of the second layer is greater than or equal to that of the first layer. This configuration increases sensitivity without sacrificing preservability of the electrically charged surface potential. The arsenic content in the first layer is preferably from 10 to 45 wt % and the arsenic content in the second layer is preferably 25 to 45 wt %.

The present invention also provides that at least the first layer of the two layer photoconductor contains iodine. Doping amorphous selenium-arsenic alloy with iodine increases the mobility of carriers and increases the photoresponse of the photoconductor. If the iodine content is too high, however, film quality deteriorates. For this reason, the iodine content should be 50,000 ppm by weight or less. Since a high iodine content lowers the sensitivity, the iodine content of the second layer (functioning mainly in carrier generation) must be less than or equal to the concentration of the first layer.

The present invention also provides for a thin multilayered photosensitive coating which produces sharp images and eliminates the image blurring associated with traditional thick photoconductors. Within the restrictions imposed by the characteristics of the photoconductive layers, the first layer must be as thick as possible, while the second layer must be as thin as possible. The first layer functions mainly to preserve electrical charge surface potential in darkness and should be in the preferred range of between 20 to 70 $\mu$m thick. The second layer functions mainly to generate carriers and should be in the preferred range of between 5 to 30 $\mu$m thick. When forming images, the thin layered photoconductor is charged to a potential of 800 V or less. This is lower than the 800 to 1200 V potential required for conventional photoconductors.

The multilayered photosensitive coating is heat treated after vacuum deposition. Heat treatment facilitates an even distribution of iodine in the photosensitive layers. Heat treatment of the photosensitive layers preferably is performed in a preferred range of between 100° to 200° for 30 to 80 minutes. The surface roughness (Rmax.) of the conductive substrate is 0.5 $\mu$m or less. Larger surface roughnesses (Rmax.) leads to point defects in the images. These defects will be present even if a low surface potential is applied to the photoconductor as mentioned above. Because of their good workability, aluminum alloys are preferred for the conductive substrate.

Briefly stated, the present invention provides a photoconductor having a first selenium-arsenic layer of a photoconductor, deposited on a conductive substrate. The first layer has a thickness and arsenic concentration effective to preserve an electrically charged surface potential in darkness and to transport carriers generated on exposure to light. The first layer is between 20 to 70 $\mu$m thick. A second amorphous selenium-arsenic alloy layer, formed on the first layer, generates carriers on exposure to light. The surface roughness, Rmax., of the conductive substrate is less than or equal to 0.5 $\mu$m. One or both of the photoconductive layers are doped with iodine. When both layers contain iodine, the iodine content of the second layer is equal to or less than that of the first layer. The thickness of the second layer is between 5 to 30 $\mu$m. The arsenic content of the amorphous selenium-arsenic alloy of the second layer is equal to or greater than that in the first layer. After deposition of the first and second layers, the photoconductor is heat treated at between 100° to 200° for 30 to 80 minutes. In a further embodiment the first layer of the photoconductor has an arsenic content in the range of 10 to 45 wt %. The second layer arsenic content is in the range of 25 to 45 wt %.

According to an embodiment of the invention, there is provided a photoconductor for electrophotography comprising: a conductive substrate, a first layer formed on the conductive substrate, a second layer formed on the first layer, the first layer being an amorphous selenium-arsenic alloy having a thickness and a first arsenic concentration effective to preserve a predetermined electrically charged surface potential in darkness and to transport carriers generated when exposed to light, and the second layer being an amorphous selenium-arsenic alloy having a second arsenic content equal to or greater than the content of the first layer.

According to a feature of the invention, there is provided method for making a photoconductor comprising: forming a first layer on a conductive substrate, forming a second layer on the first layer, the first layer being an amorphous selenium-arsenic alloy having a first thickness and a first arsenic concentration, the second layer being an amorphous selenium-arsenic alloy having a second arsenic concentration equal to or greater than an the arsenic content of the first layer, heat treating the photoconductor at a temperature of from about 100° to about 200° for from about 30 to about 80 minutes.

The above, and other objects, features and advantages of the present invention will become apparent from the following description read in conjunction with the accompanying drawings, in which like reference numerals designate the same elements.

BRIEF DESCRIPTION OF THE DRAWINGS.

FIG. 1 is a schematic view of a cross section of the layer structure of the photoconductor relevant to the present invention.

FIG. 2 is a diagram to which reference will be made in explaining the process of image formation.

FIG. 3 is a diagram to which reference will be made in explaining the charging, exposing, and potential decaying processes in the conventional photoconductor.

DETAILED DESCRIPTION OF THE PREFERRED EMBODIMENT

Figure 4:
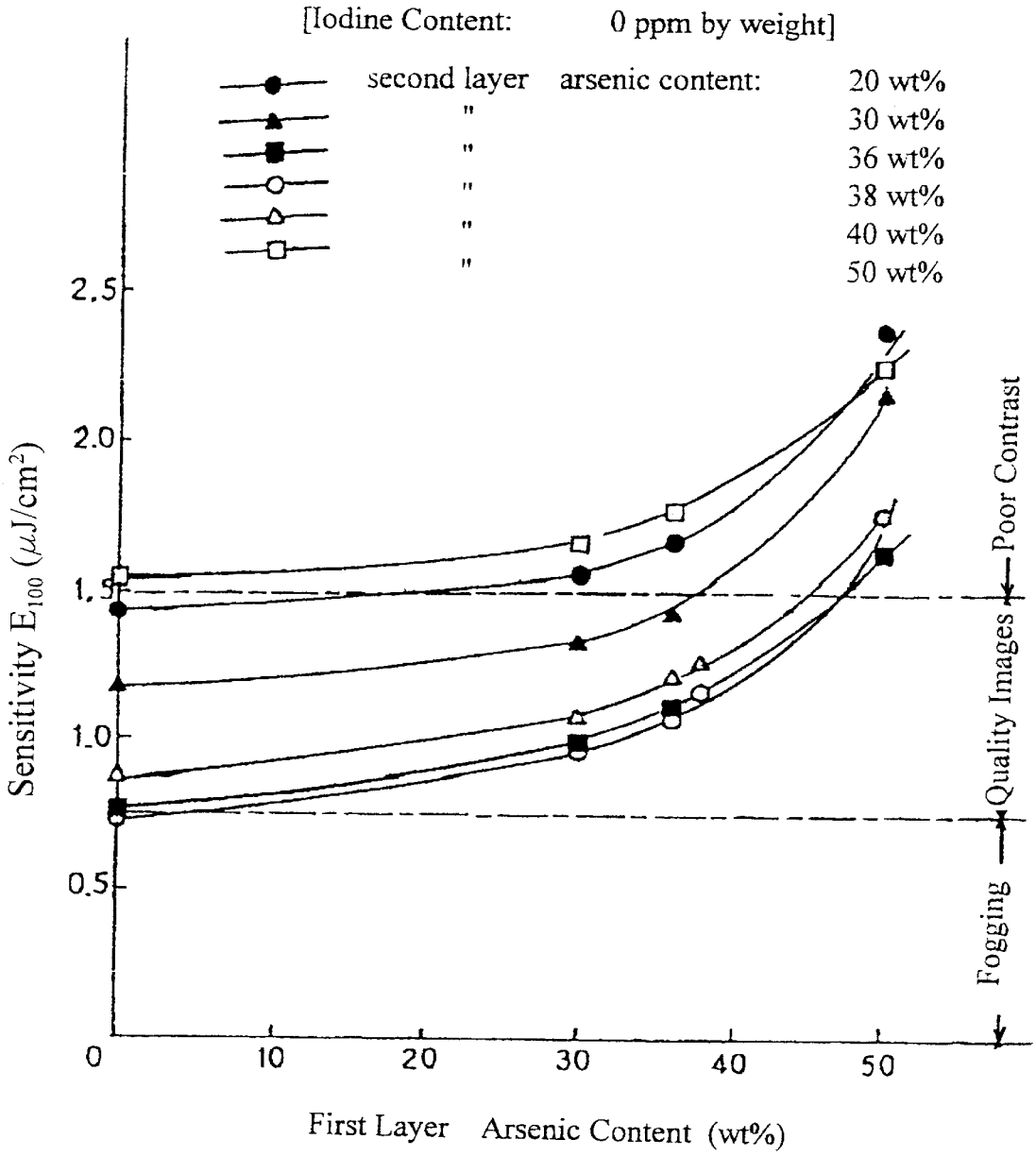
FIG. 4 is a line graph representation of the relationship between the sensitivity and the arsenic content in the first and second layers of the multilayered photosensitive coating. Both layers are made of an amorphous selenium-arsenic alloys with zero iodine content.

Referring to FIG. 1 a photoconductor 20 includes a conductive substrate 1 with a multilayered photosensitive coating 2 formed thereon. The multilayered photosensitive coating 2 is composed of a first layer 3 on the conductive substrate 1. A second layer 4 is formed on the first layer 3.

The first layer 3 and the second layer 4 of the multilayered photosensitive coating 2 are made of amorphous selenium-arsenic alloys.

Figure 5:
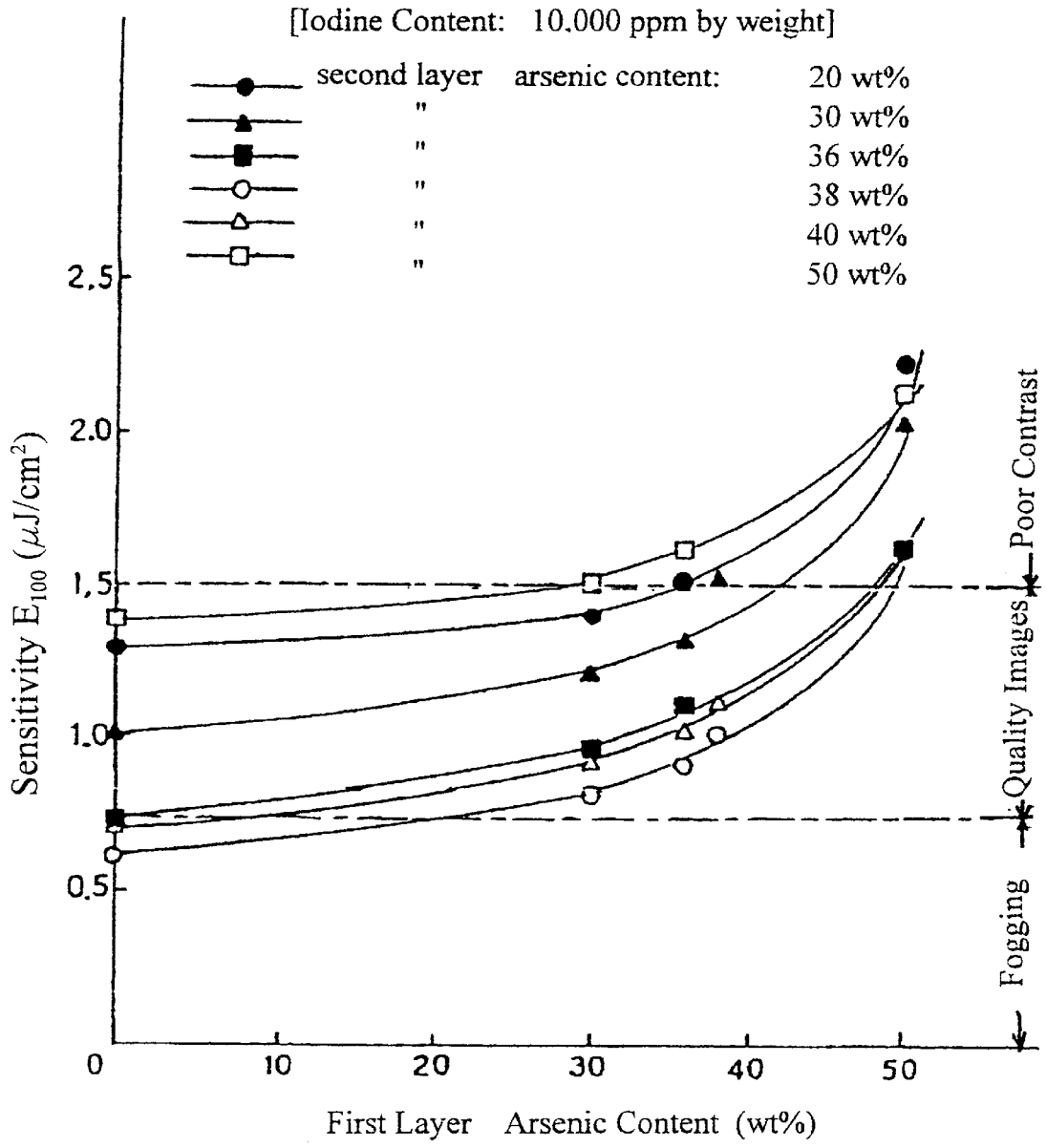
FIG. 5 is a line graph representation of the relationship between the sensitivity and the arsenic content in the first and second layers of the multilayered photosensitive coating. Both layers are made of an amorphous selenium-arsenic alloys doped with iodine at a concentration of 10,000 ppm by weight.
Figure 6:
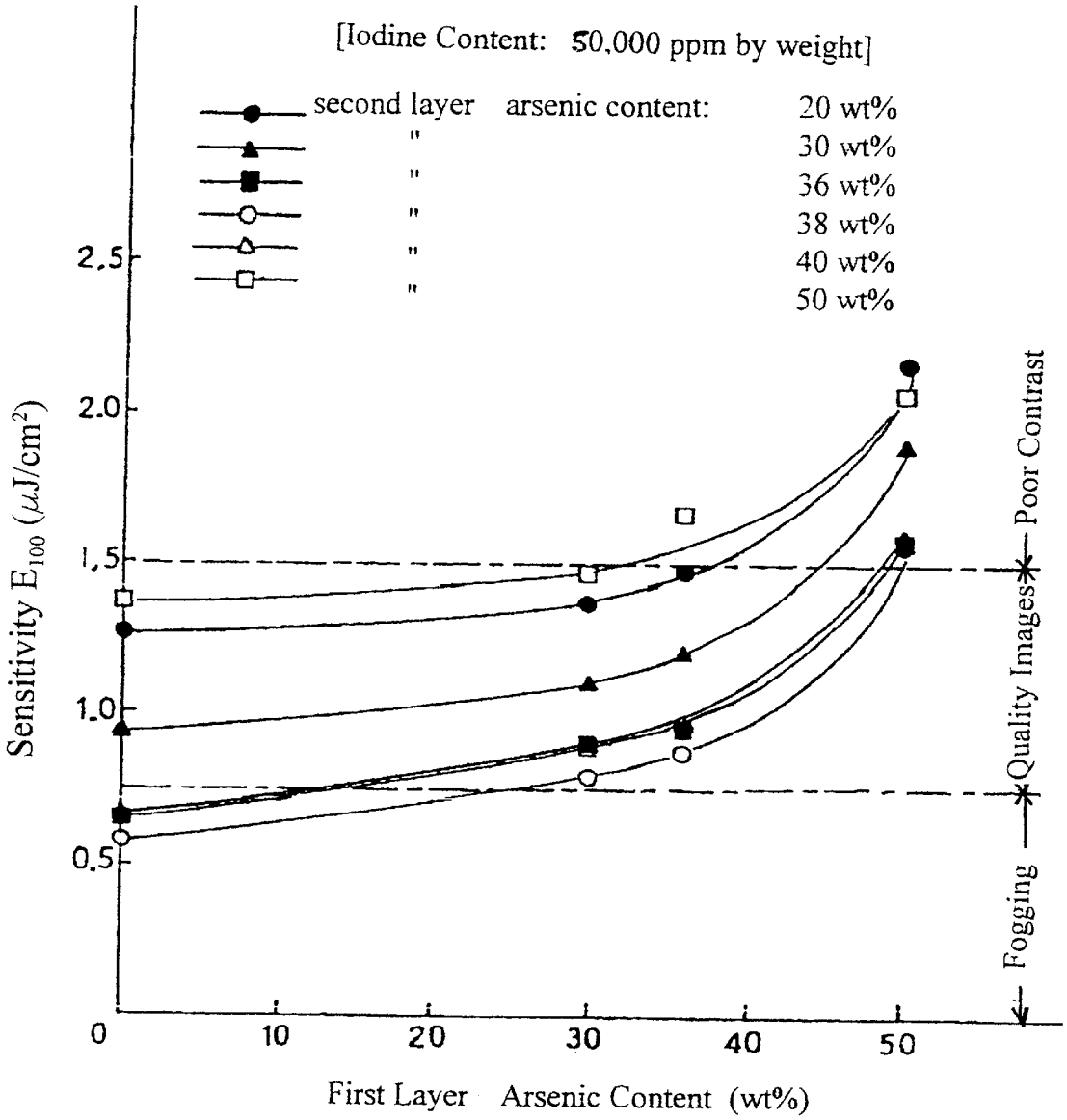
FIG. 6 is a line graph representation of the relationship between the sensitivity and the arsenic content in the first and second layers of the multilayered photosensitive coating. Both layers are made of an amorphous selenium-arsenic alloys doped with iodine at a concentration of 50,000 ppm by weight.

Referring to FIGS. 4 through 6, the graph display the photoconductor sensitivity as ordinate with the first layer arsenic content as abscissa. The second layer arsenic content, and iodine content of the first and second layers are displayed as parameters. The second layer displayed values of 20, 30, 36, 38.6 (stoichiometric composition), 40 and 50 for the arsenic concentration measured in wt %. The thickness of the first layer is 30 μm. The second layer is 10 μm thick. The photoconductor sensitivity is denoted as the photoenergy, $E_{100}$, required to reduce an electrically charged surface potential from 800 V to 100 V when exposed to monochromatic light with a wave length of 640 μm. The zones represented by long and short dashed lines indicate image qualities in terms of sensitivity.

Referring now to FIG. 4, the photoconductor sensitivity is plotted against the first layer arsenic content when the iodine content of both layers is zero. Good images in terms of sensitivity are produced when the first layer arsenic content is approximately 47 wt % or less and the second layer arsenic content is approximately 45 wt % or less.

Referring now to FIG. 5, the photoconductor sensitivity is plotted against the first layer arsenic content when the iodine content of both layers is 10,000 ppm by weight. Good images in terms of sensitivity are obtained when the first layer arsenic content is approximately 48 wt % or less and the second layer arsenic content is approximately 45 wt % or less.

Referring now to FIG. 6, the photoconductor sensitivity is plotted against first layer arsenic content when the iodine content of both layers is 50,000 ppm by weight. Good images in terms of sensitivity are produced when the first layer arsenic content is approximately 49 wt % or less, and the second layer arsenic content is approximately 45 wt % or less.

The complementary functions of the two layers, when combined, eliminates the need for a higher arsenic content in the first layer over that in the second layer. Thus, the first layer arsenic content is in the preferred range of 10 to 45 wt %, and the second layer arsenic content is in the preferred range of 25 to 45 wt %. This means that the first layer arsenic content is less than or equal to the arsenic content of the second layer.

Returning now to FIG. 4 through FIG. 6, the iodine content is the same in both layers. Given that a higher iodine content lowers the sensitivity, the iodine content of the second layer should be equal to or less than the content of the first layer.

Figure 7:
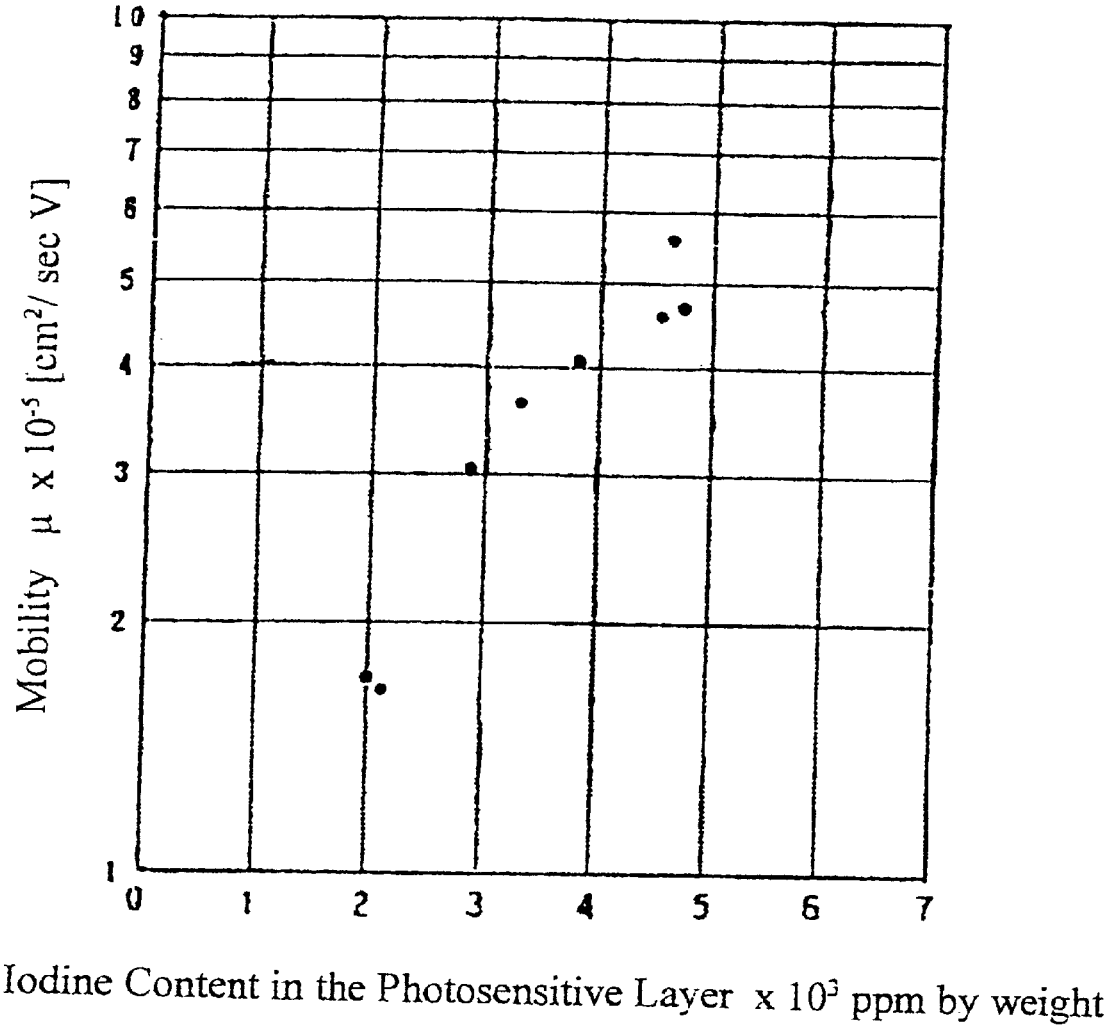
FIG. 7 is a graph of the relationship between the carrier mobility and the iodine content in the amorphous selenium-arsenic alloy. The arsenic content is 38.6 wt %.

Referring to FIG. 7, increasing the iodine content in the amorphous selenium-arsenic alloy increases the mobility of carriers. However, other experiments (description omitted herein) demonstrate that when the iodine content is 50,000 ppm by weight or more, film quality is reduced and defects such as pinholes in the film become apparent. This means that the iodine content in both layers must be 50,000 ppm or less.

Since the first layer must be thicker than the second layer, the thickness of the first layer should be in the preferred range of 20 to 70 μm. The thickness of the second layer should be in the preferred range of 5 to 30 μm. The substrate should have a surface roughness, Rmax., of 0.5 μm or less. It is preferable to have Rmax. be 0.3 μm or less. This roughness can be produced by surface processing with, for example, diamond cutting tools. Aluminum alloys, nickel alloys, and stainless steel can be used as substrate material. Because of their excellent work-ability, aluminum alloys are preferred.

EXAMPLE 1

An outer surface of a cylinder of an aluminum alloy is processed to give a substrate a surface roughness, Rmax., of 0.3 μm. An amorphous selenium-arsenic alloy with an arsenic content of 35 wt % and an iodine content of 5,000 ppm by weight is vacuum deposited onto the outer surface of the processed substrate. This produces an amorphous first layer 30 μm thick. An amorphous selenium-arsenic alloy with arsenic content of 38.6 wt % and an iodine content of 1,000 ppm by weight is deposited on the first layer to give a second layer 10 μm thick. Thus, a multilayered photosensitive coating 40 μm thick is formed consisting of a first and second layer. The formed device is heat treated at a temperature of 150° for 60 minutes.

EXAMPLE 2

The photoconductor in Example 2 is prepared in the same manner as Example 1 except that the first layer is 50 μm thick. This produces a multilayered photosensitive coating that is 60 μm thick.

Comparative Example 1

An outer surface of a cylinder of aluminum alloy is processed to give a substrate the surface roughness, Rmax., of 0.8 μm. An amorphous selenium-arsenic alloy with an arsenic content of 38.6 wt % and a zero iodine content is vacuum deposited on the substrate. This produces a single-layered amorphous photosensitive layer 40 μm thick. The photosensitive layer is aged in light and dark conditions for 24 hours respectively.

Comparative Example 2

The photoconductor of Comparative Example 2 is prepared in the same manner as Comparative Example 1 except that a photosensitive coating that is 60 μm thick is deposited on the substrate.

Measurements are made on the following:

Carrier Mobility,

Layer Thickness,

Drift Velocity S=(1 V/L) where L is the thickness of the photosensitive coating, and Sensitivity ($E_{100}$).

Referring to Table 1, demonstrating that the photoconductors referred to in Example 1 and Example 2 with the multilayered photosensitive coating have a remarkable increase in carrier mobility and sensitivity compared with the photoconductors of Comparative Example 1 and 2. It also indicates that the thinner photoconductor in Example 1, despite its lower sensitivity, has a higher drift velocity and good photoresponse when compared with the photoconductor in Example 2.

Image quality (resolution, blurredness, image defects (such as point defects)) is evaluated with the photoconductor mounted on a printer which has the following characteristics:

printing speed of 200 sheets/min. (peripheral velocity of 800 mm/s);

dot density of 600 dpi;

electrically charged surface potential of 600 V;

an exposing light wave length of 640 μm.

Referring to Table 2, the results are shown in terms of the marks, ○, Δ, and X which denote excellent, normal, and poor quality respectively.

TABLE 2

| Photo-conductor | Layer Thickness (μm) | Resolution | Blurredness | Image Defects | Overall Evaluation |
|---|---|---|---|---|---|
| Example 1 | 40 | ○ | ○ | ○ | ○ |
| Example 2 | 60 | Δ | Δ | ○ | Δ |
| Comparative Example 1 | 40 | Δ | ○ | Δ | Δ |
| Comparative Example 2 | 60 | X | Δ | ○ | X |

Again referring to Table 2, the multilayered photoconductor (composed of a first and second layer, doped with iodine, and decreased in thickness) referred to in Example 1 has the best image quality. It further demonstrates that the thin mono-layer photoconductor of Comparative Example 1 causes point defects to appear in the images.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

a conductive substrate;

a first layer formed on said conductive substrate;

a second layer formed on said first layer;

said first layer being an amorphous selenium-arsenic alloy having a thickness and a first arsenic concentration effective to preserve a predetermined electrically charged surface potential in darkness and to transport carriers generated when exposed to light; and said second layer being an amorphous selenium-arsenic alloy having a second arsenic concentration greater than said first arsenic concentration;

said first arsenic concentration being substantially uniform over said first layer; and said second arsenic concentration being substantially uniform over said second layer.

2. A photoconductor according to claim 1, wherein:

said first arsenic concentration being from about 10 to about 45 wt %; and said second arsenic concentration being from about 25 to about 45 wt %.

3. A photoconductor according to claim 1, wherein at least said first layer includes a percentage of iodine.

4. A photoconductor according to claim 2, wherein at least said first layer includes a percentage of iodine.

5. A photoconductor according to claim 1, wherein said first layer and said second layer include percentages of iodine.

6. A photoconductor according to claim 2, wherein said first layer and said second layer include percentages of iodine.

7. A photoconductor according to claim 5, wherein an iodine content in said second layer is equal to or lower than an iodine content in said first layer.

8. A photoconductor according to claim 6, wherein said second layer has an iodine content that is equal to or lower than an iodine content in said first layer.

9. A photoconductor according to claim 3, wherein an iodine content in at least said first layer is less than or equal to 50,000 ppm by weight.

10. A photoconductor according to claim 4, wherein at least said first layer is doped with iodine in an amount less than or equal to 50,000 ppm by weight.

11. A photoconductor according to claim 7, wherein at least one of said first layer and said second layer is doped with iodine in an amount less than or equal to 50,000 ppm by weight.

12. A photoconductor according to claim 8, wherein at least one of said first layer and said second layer is doped with iodine in an amount less than or equal to 50,000 ppm by weight.

13. A photoconductor according to claim 1, wherein:

said first layer is from about 20 to about 70 μm thick; and said second layer is from about 5 to about 30 μm thick.

14. A photoconductor according to claim 2, wherein:

said first layer has a thickness of from about 20 to about 70 μm;

said second layer has a thickness of from about 5 to about 30 μm.

15. A photoconductor according to claim 3, wherein:

said first layer having a thickness of from about 20 to about 70 μm; and said second layer has a thickness of from about 5 to about 30 μm.

16. A photoconductor according to claim 4, wherein:

said first layer having a thickness of 20 to 70 μm; and said second layer being 5 to 30 μm thick.

17. A method for making a photoconductor comprising:

forming a first layer on a conductive substrate;

forming a second layer on said first layer;

said first layer being an amorphous selenium-arsenic alloy having a first thickness and a first arsenic concentration effective to preserve a predetermined electrically charged surface potential in darkness and to transport carriers generated when exposed to light;

said second layer being an amorphous selenium-arsenic alloy having a second arsenic concentration greater than said first arsenic concentration;

said first arsenic concentration being substantially uniform over said first layer;

said second arsenic concentration being substantially uniform over said second layer; and heat treating said photoconductor at a temperature of from about 100° C. to about 200° C. for from about 30 to about 80 minutes.

18. A photoconductor according to claim 1, wherein a surface roughness Rmax. of said conductive substrate is less than or equal to 0.5 μm.

19. A photoconductor according to claim 1, wherein said conductive substrate is made of aluminum alloy.

* * * * *